US010400196B2

(12) United States Patent
Burgan et al.

(10) Patent No.: US 10,400,196 B2
(45) Date of Patent: Sep. 3, 2019

(54) NATURAL LAUNDRY DETERGENT

(71) Applicant: FLASHDOG, LLC, Indianapolis, IN (US)

(72) Inventors: Blaine Burgan, Indianapolis, IN (US); Seth Foster, North Sioux City, SD (US)

(73) Assignee: FlashDog LLC, Indianapolis, IN (US)

( * ) Notice: Subject to any disclaimer, the term of this patent is extended or adjusted under 35 U.S.C. 154(b) by 0 days.

(21) Appl. No.: 15/677,235

(22) Filed: Aug. 15, 2017

(65) Prior Publication Data

US 2019/0055498 A1 Feb. 21, 2019

(51) Int. Cl.

| | |
|---|---|
| ***C11D 1/66*** | (2006.01) |
| ***C11D 3/22*** | (2006.01) |
| ***C11D 3/37*** | (2006.01) |
| ***C11D 3/382*** | (2006.01) |
| ***C11D 3/20*** | (2006.01) |
| ***C11D 3/48*** | (2006.01) |
| ***C11D 10/04*** | (2006.01) |
| ***C11D 17/00*** | (2006.01) |
| *C11D 1/62* | (2006.01) |

(52) U.S. Cl.

CPC ..... *C11D 3/382* (2013.01); *C11D 1/66* (2013.01); *C11D 3/2082* (2013.01); *C11D 3/2086* (2013.01); *C11D 3/222* (2013.01); *C11D 3/48* (2013.01); *C11D 10/04* (2013.01); *C11D 10/045* (2013.01); *C11D 17/0008* (2013.01); *C11D 1/62* (2013.01); *C11D 1/662* (2013.01)

(58) Field of Classification Search

CPC .... C11D 1/66; C11D 3/22; C11D 3/37; C11D 3/382

See application file for complete search history.

(56) References Cited

U.S. PATENT DOCUMENTS

2016/0108347 A1* 4/2016 McCarthy ..... C11D 3/2075 510/220

* cited by examiner

*Primary Examiner* — Brian P Mruk

(74) *Attorney, Agent, or Firm* — Ryan O. White; Taft Stettinius & Hollister LLP

(57) ABSTRACT

A natural laundry detergent, including an emulsifier in an amount of from about 20% to about 40% by weight of the composition, a natural surfactant in an amount of from about 3.0% to about 23% by weight of the composition, water in an amount of less than about 60% by weight of the composition, a saponified oil in an amount of from about 0.50% to about 10.5% by weight of the composition, an organic chelating agent in an amount of from about 0.10% to about 2.5% by weight of the composition, one or more preservative in an amount of from about 0.10% to about 2.0% by weight of the composition, and a polymeric thickening component in an amount of from about 0.05% to about 1.0% by weight of the composition.

26 Claims, No Drawings

NATURAL LAUNDRY DETERGENT

TECHNICAL FIELD

The present invention relates generally to laundry detergent compositions, and more particularly to highly concentrated laundry detergent compositions containing natural and eco-friendly ingredients.

BACKGROUND OF THE DISCLOSURE

The statements in this section merely provide background information related to the present disclosure and should not be construed as constituting prior art.

Liquid cleaning compositions and solutions, including laundry detergents, have been known for many years. A majority of these compositions contain various blends of synthetic ingredients, such as surfactants, solvents, builders, conditioners, dispersants, soil-release polymers, detersive enzymes and bleaching agents. While laundry detergents containing such synthetic ingredients may exhibit adequate cleaning properties, many of these detergents are petroleum-based and contain a host of potentially toxic chemicals that are harsh on the environment. As a result, efforts have been made over the past few years to move towards laundry detergents that contain more natural and eco-friendly ingredients. Despite these efforts, however, many products continue to use synthetic surfactants that although biodegradable, pollute nonetheless because they are petroleum derived. In addition, many formulations only contain some natural ingredients and still utilize solvents, synthetic polymers, as well as chelants and bleaching agents that may still negatively impact the environment. Moreover, as laundry detergents contain more natural ingredients, it is increasingly difficult to achieve a formulation that exhibits acceptable consumer performance properties, particularly as adequate performance has been conventionally tied to the use of multiple surfactants, solvents, and builders.

As such, there is a need for laundry detergent compositions that contain a minimum number of natural ingredients, including ingredients derived from natural sources, such as plant and mineral based sources. It is therefore an object of the present invention to provide laundry detergent compositions that overcome and address the deficiencies, disadvantages and shortcomings that are typically seen with conventional laundry detergent compositions.

SUMMARY OF THE DISCLOSURE

In accordance with one embodiment herein, the present invention is directed to a natural laundry detergent, comprising an emulsifier in an amount of from about 20% to about 40% by weight of the composition, a natural surfactant in an amount of from about 3.0% to about 23% by weight of the composition, water in an amount of less than about 60% by weight of the composition, a saponified oil in an amount of from about 0.50% to about 10.5% by weight of the composition, an organic chelating agent in an amount of from about 0.10% to about 2.5% by weight of the composition, one or more preservative in an amount of from about 0.10% to about 2.0% by weight of the composition, and a polymeric thickening component in an amount of from about 0.05% to about 1.0% by weight of the composition.

According to certain aspects herein, the natural surfactant includes one or more fruit extracts. In accordance with certain illustrative embodiments, the one or more fruit extracts are obtained from at least one of *Sapindus delavay, Sapindus detergens, Sapindus emarginatus, Sapindus laurifolius, Sapindus marginatus, Sapindus mukorossi, Sapindus oahuensis, Sapindus rarak, Sapindus saponaria, Sapindus tomentosus, Sapindus trifoliatus*, and *Sapindus vitiensis*.

According to yet other embodiments herein, the natural surfactant comprises a non-ionic botanical surfactant. In accordance with certain illustrative embodiments, the non-ionic botanical surfactant comprises berry saponin concentrate that is present in an amount of from about 8.0% to about 16% by weight of the composition.

In accordance with still other aspects herein, the emulsifier comprises an alkyl polyglucoside emulsifier that is present in the amount of from about 28% to about 32% by weight of the composition.

According to yet still other embodiments, the natural laundry detergent comprises a saponified oil that is derived from a vegetable oil or animal fat selected from the group consisting of almond oil, apricot kernel oil, avocado oil, babassu oil, beef tallow, borage oil, canola oil, castor oil, cocoa butter, coconut oil, corn oil, cottonseed oil, emu oil, grapeseed oil, hazelnut oil, illipe butter, jojoba oil, kukui nut oil, lard, macadamia nut oil, mango butter, neem oil, olive oil, palm oil, palm kernel oil, peach kernel oil, peanut oil, rice bran oil, safflower oil, sesame oil, shea butter, soybean oil, stearic acid, sunflower oil, walnut oil, and wheat germ oil. According to certain illustrative embodiments herein, the saponified oil is present in an amount of from about 2.0% to about 5.0% by weight of the composition.

According to other illustrative embodiments, the natural laundry detergent comprises an organic chelating agent that includes a gluconate selected from sodium gluconate, potassium gluconate, lithium gluconate, zinc gluconate, ferrous gluconate, and mixtures thereof. In accordance with certain specific aspects, the gluconate is present in an amount of from about 1.0% to about 1.8% by weight of the composition.

In accordance with certain embodiments herein, the natural laundry detergent includes one or more preservative selected from the group consisting of quaternary ammonium chlorides, quaternary ammonium carbonates, benzalkonium chloride, iodine containing compounds, hydantoins, isothiazolinones, parabens, dehydroacetic acid and salts thereof, isocil, chloroxylenol, chlorhexidine, phenoxyethanol, benzyl alcohol, phenethyl alcohol, benzoic acid and salts thereof, chlorobutanol, sorbic acid and salts thereof, triclosan, triclocarban, and mixtures thereof. According to certain aspects of this illustrative embodiment, the one or more preservative is present in the amount of from about 0.50% to about 1.50% by weight of the composition.

In accordance with still other aspects of the present invention, the natural laundry detergent further comprises potassium hydroxide.

According to yet other aspects of the present invention, the natural laundry detergent comprises a carrier including a blend of water and effective amounts of a fruit extract, one or more saponified oils and glycerin. Moreover, according to still other aspects herein, the carrier further comprises one or more processing aids configured to adjust the pH of the composition.

According to certain embodiments herein, the carrier of the natural laundry detergent further comprises a natural viscosifier or a thickening agent.

According to still other aspects herein, the natural laundry detergent of the present invention includes a polymeric thickening component that is selected from the group consisting of a natural polysaccharide or a cellulose material. In accordance with certain illustrative embodiments, the natural polysaccharide or the cellulose material is selected from the group consisting of guar gum, locust bean gum and xanthan gum.

In accordance with yet other aspects of the present invention, the natural laundry detergent includes a polymeric thickening component that is present in an amount of from about 0.20% to about 0.50% by weight of the composition.

According to still other embodiments, the natural laundry detergent further comprises an organic aloe.

In accordance with yet other aspects of the present invention, the natural laundry detergent has a specific gravity between about 1.12 and about 1.13 and a pH between about 9 and about 10.

According to yet another illustrative embodiment of the present invention, a natural laundry detergent is provided that comprises an alkyl polyglucoside emulsifier that is present in the amount of from about 28% to about 32% by weight of the composition, a non-ionic botanical surfactant including a berry saponin concentrate, wherein the berry saponin concentrate is present in an amount of from about 8.0% to about 16% by weight of the composition, water in an amount of from about 40% to about 50% by weight of the composition, and a saponified oil in an amount of from about 2.0% to about 5.0% by weight of the composition, wherein the saponified oil is derived from a vegetable oil or animal fat that is selected from the group consisting of almond oil, apricot kernel oil, avocado oil, babassu oil, beef tallow, borage oil, canola oil, castor oil, cocoa butter, coconut oil, corn oil, cottonseed oil, emu oil, grapeseed oil, hazelnut oil, illipe butter, jojoba oil, kukui nut oil, lard, macadamia nut oil, mango butter, neem oil, olive oil, palm oil, palm kernel oil, peach kernel oil, peanut oil, rice bran oil, safflower oil, sesame oil, shea butter, soybean oil, stearic acid, sunflower oil, walnut oil, and wheat germ oil. The detergent further comprises an organic chelating agent including a gluconate selected from sodium gluconate, potassium gluconate, lithium gluconate, zinc gluconate, ferrous gluconate, and mixtures thereof, wherein the gluconate is present in an amount of from about 1.0% to about 1.8% by weight of the composition, and a polymeric thickening component in an amount of from about 0.20% to about 0.50% by weight of the composition, wherein the polymeric thickening component is selected from the group consisting of a natural polysaccharide or a cellulose material, and an organic aloe. In accordance with this illustrative embodiment, the detergent has a specific gravity between about 1.12 and about 1.13 and a pH between about 9 and about 10.

DETAILED DESCRIPTION

The embodiments of the present application described below are not intended to be exhaustive or to limit the teachings of the present application to the precise forms disclosed in the following detailed description. Rather, the embodiments are chosen and described so that others skilled in the art may appreciate and understand the principles and practices of the present application.

Unless defined otherwise, all technical and scientific terms used herein have the same meaning as commonly understood by one of ordinary skill in the art to which this application belongs. Moreover, it should be understood that when certain values and ranges are recited herein in connection with various embodiments of the present teachings, all values and ranges which fall between such listed values and ranges are intended to be encompassed by the present teaching unless explicitly stated otherwise. Finally, although specific methods and materials are described herein with respect to certain exemplary aspects of the present teachings, it should be understood and appreciated that other methods and materials similar or equivalent to those described herein can be used in the practice or testing of the present application without straying from the invention's intended scope.

In accordance with the various illustrative embodiments of the present invention, effective amounts of ingredients should be generally understood to refer to those amounts listed as the ranges or levels of ingredients as disclosed throughout the description herein.

The present invention relates to natural compositions for laundering fabrics, the compositions including entirely ecologically friendly ingredients, yet still exhibiting good performance properties, such as stain removal and whiteness retention. In accordance with one embodiment, the natural compositions contain one or more emulsifiers, such as an alkyl polyglucoside emulsifier. In accordance with certain embodiments, the polyglucoside emulsifiers belong to a class of "surface active agents", or surfactants, that have a naturally derived alkyl substituent, such as a coconut fatty alcohol or a distilled cut of a natural fatty alcohol. According to certain aspects herein, the alkyl polyglucoside is made from renewable resources and is free from petroleum derived components, such as ethoxylate or propoxylate.

Suitable alkyl polyglucoside emulsifiers, in accordance with certain aspects herein, include alkyl polyglucosides having a hydrophobic group containing from about 6 to about 30 carbon atoms, or from about 10 to about 16 carbon atoms and polysaccharide, e.g., a polyglycoside (polyglucoside), hydrophilic group containing from about 1.3 to about 10, or from about 1.3 to about 3, or from about 1.3 to about 2.7 saccharide units. Optionally, there can be a polyalkyleneoxide chain joining the hydrophobic moiety and the polysaccharide moiety. A suitable alkyleneoxide is ethylene oxide. Typical hydrophobic groups include alkyl groups, either saturated or unsaturated, branched or unbranched containing from about 8 to about 18, or from about 10 to about 16, carbon atoms. Suitably, the alkyl group can contain up to about 3 hydroxy groups and/or the polyalkyleneoxide chain can contain up to about 10, or less than about 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexaglucosides.

Suitable alkyl glucoside emulsifiers include, for example, APG 425® (a coconut alkyl polyglucoside having naturally derived components available from Cognis Corporation), APG 325® (a C9-C11 alkyl polyglucoside available from Cognis Corporation), APG 625® (a C10-C16 alkyl polyglucoside available from Cognis Corporation), Dow Triton® CG110 (a C8-C10 alkyl polyglucoside available from Dow Chemical Company), AG6202® (a C8 alkyl polyglucoside available from Akzo Nobel) and Alkadet 15® (a C8-C10 alkyl polyglucoside available from Huntsman Corporation). A C8 to C10 alkylpolygluco-side includes alkylpolyglucosides wherein the alkyl group is substantially C8 alkyl, substantially C10 alkyl, or a mixture of substantially C8 and C10 alkyl.

In accordance with certain aspects herein, the alkyl polyglucoside is present in the natural laundry detergent in an amount ranging from about 20 to about 40 weight percent of the composition, or more particularly from about 25 to about 35 weight percent of the composition, or even more specifically from about 28 to about 32 weight percent of the composition. In accordance with specific embodiments, the alkyl polyglucoside is present in an amount of about 30 weight percent of the composition.

In accordance with one embodiment herein, the natural laundry detergent compositions also contain one or more natural surfactants, and particularly natural surfactants having a diverse range of cleansing, anti-bacterial, and/or anti-fungal properties. In accordance with certain embodiments, the natural surfactants include fruit extracts obtained from shrubs or small trees belonging to the genus *Sapindus*, which includes a number of species including, but not limited to, *Sapindus delavay, Sapindus detergens, Sapindus emarginatus, Sapindus laurifolius, Sapindus marginatus, Sapindus mukorossi, Sapindus oahuensis, Sapindus rarak, Sapindus saponaria, Sapindus lomenlosus, Sapindus trifoliaius*, and *Sapindus viliensis*.

In accordance with certain aspects herein, the natural laundry detergent compositions include a non-ionic botanical surfactant, such as a berry saponin concentrate (BSC), which is comprised of naturally occurring saponins found in the *Sapindus mukorossi* fruit. As is generally known within the detergent arts, BSC acts as a gentle cleanser and exhibits many functions and properties that promote cleansing, foaming, emulsification, wetting, conditioning and solubilization. Moreover, it also works well as a secondary or co-surfactant for a variety of personal care products.

In accordance with certain aspects herein, the one or more natural surfactants are present in the natural laundry detergent in an amount ranging from about 3.0 to about 23 weight percent of the composition, or more particularly from about 5.0 to about 20 weight percent of the composition, or even more specifically from about 8.0 to about 16 weight percent of the composition. In accordance with specific embodiments, the one or more natural surfactants are present in an amount of about 13 weight percent of the composition.

In some embodiments, the presently disclosed natural laundry detergent compositions include a carrier, such as a blend of water, comprising effective amounts of a fruit extract in combination with one or more saponified oils, glycerin, optionally one or more processing aids for pH adjustment (if required) or as a residual reagent from the saponification process; and a natural viscosifier or thickening agent, such as xanthan gum. According to such an embodiment, the solution can be used as a natural cleaning agent/detergent, which exhibits commercially acceptable cleaning properties. When the composition is an aqueous composition, water can be a predominant ingredient. In accordance with certain aspects herein, water can be present at a level of less than 60 weight percent, more preferably less than about 55 weight percent, and most preferably, less than about 50 weight percent. In specific embodiments, water is present in an amount of between about 35 and 55 weight percent of the composition, and more specifically between about 40 and 50 weight percent. In accordance with specific embodiments, water is present in an amount of about 45.55 weight percent of the composition. In addition, in accordance with certain aspects herein, deionized or filtered water is preferred.

In accordance with certain aspects herein, the natural laundry detergent compositions further include a saponified oil prepared by the hydrolysis of a vegetable oil, i.e., a triglyceride extracted from a plant, or an animal fat with a strong alkali, such as sodium hydroxide, potassium hydroxide, or combinations thereof, to form the carboxylate salt, e.g., a sodium or potassium salt, and glycerol (also referred to as glycerin, i.e., propane-1,2,3-triol ($C_3H_8O_3$)).

Representative saponified oils suitable for use with the presently disclosed compositions, formulations, and solutions can be prepared by the saponification of vegetable oils and animal fats known in the art including, but not limited to, almond oil, apricot kernel oil, avocado oil, babassu oil, beef tallow, borage oil, canola oil, castor oil, cocoa butter, coconut oil, corn oil, cottonseed oil, crisco shortening, emu oil, grapeseed oil, hazelnut oil, illipe butter, jojoba oil, kukui nut oil, lard, macadamia nut oil, mango butter, neem oil, olive oil, palm oil, palm kernel oil, peach kernel oil, peanut oil, rice bran oil, safflower oil, sesame oil, shea butter, soybean oil, stearic acid, sunflower oil, walnut oil, and wheat germ oil.

One of ordinary skill in the art would understand and appreciate herein that the ingredients used in the saponification process influence the characteristics of the presently disclosed natural laundry detergent compositions, including the composition's hardness/softness, cleansing ability, lathering ability, etc.

In accordance with certain aspects herein, the saponified oil is present in the natural laundry detergent in an amount ranging from about 0.50 to about 10.5 weight percent of the composition, or more particularly from about 1.0 to about 7.0 weight percent, or even more specifically from about 2.0 to about 5.0 weight percent. In accordance with specific embodiments, the saponified oil is present in an amount of about 3.5 weight percent of the composition.

In accordance with another aspect of the present invention, a gluconate can be used as an organic chelating agent for purposes of functioning as a water softener. Non-limiting examples of gluconates that may be used in accordance with the present invention include, sodium gluconate, potassium gluconate, lithium gluconate, zinc gluconate, ferrous gluconate, and mixtures thereof.

In accordance with certain aspects herein, the gluconate chelating agent is present in the natural laundry detergent in an amount ranging from about 0.10 to about 2.5 weight percent of the composition, or more particularly from about 0.50 to about 2.0 weight percent, or even more specifically from about 1.0 to about 1.8 weight percent. In accordance with specific embodiments, the gluconate chelating agent is present in an amount of about 1.50 weight percent of the composition.

In accordance with still other aspects of the present invention, the natural laundry detergent compositions may also include one or more preservatives or other such adjuvants, including, but not limited to, quaternary ammonium chlorides; quaternary ammonium carbonates; benzalkonium chloride; iodine containing compounds, such as 3-iodo-2-propynyl butyl carbamate (IPBC); hydantoins, such as dimethylhydantoin and halogenated hydantoins; isothiazolinones; parabens, such as methylparaben, ethylparaben, and propylparaben; dehydroacetic acid and salts thereof; isocil; chloroxylenol; chlorhexidine; phenoxyethanol; benzyl alcohol; phenethyl alcohol; benzoic acid and salts thereof such as sodium benzoate; chlorobutanol; sorbic acid and salts thereof; triclosan; triclocarban; and any combination of any of the foregoing.

In accordance with certain aspects herein, the one or more preservatives are present in the natural laundry detergent in an amount ranging from about 0.10 to about 2.0 weight percent of the composition, or more particularly from about 0.25 to about 1.75 weight percent, or even more specifically from about 0.50 to about 1.50 weight percent. In accordance with specific embodiments, the one or more preservatives are present in an amount of about 1.0 weight percent of the composition.

The present natural laundry detergent compositions, in accordance with certain embodiments, can also include a polymeric thickening component that includes a cellulose thickening polymer having a water-soluble or water dispersible polymeric material. According to specific embodiments herein, the polymeric thickening component includes a natural polysaccharide or cellulose material including, but not limited to, guar gum, locust bean gum, and xanthan gum.

In accordance with certain aspects herein, the polymeric thickening components are present in the natural laundry detergent in an amount ranging from about 0.05 to about 1.0 weight percent, or more particularly from about 0.10 to about 0.75 weight percent, or even more specifically from about 0.20 to about 0.50 weight percent. In accordance with specific embodiments, the polymeric thickening components are present in an amount of about 0.35 weight percent of the composition.

Further, depending on the particular formulations, it should be understood and appreciated herein that additional ingredients, such as fruit extracts or derivatives thereof, glycerin, aloe (aloe vera), enzymes, and/or sodium derivatives, can be provided in differing amounts as illustrated by the examples described herein below to provide appropriate texturing and foaming capabilities and stability.

Various processes, methods, compositions and devices of the present disclosure are demonstrated in the following examples. These examples are illustrative only and are not intended to limit or preclude other embodiments of the present invention.

Example 1

A natural laundry detergent composition was prepared in accordance with the teachings of the present invention. Phase 1: In the first phase of the process, a mixing vessel was charged with 456 gallons of de-ionized water and then the vessel's propeller mixer is activated to agitate the water. 130 gallons of Organic Berry Saponin Concentrate (BSC), 300 gallons of alkyl polyglucoside and 150 pounds of sodium gluconate are added to the mixing vessel containing the de-ionized water until fully solubilized. To avoid the presence of foam during the agitation process, the mixing speed is adjusted as needed, and the pH of the solution is adjusted to between 9 and 10 with potassium hydroxide.

Table 1 shows the listing of ingredients, and specific percentages used, to formulate the phase 1 mixture.

TABLE 1

(Phase 1 mixture)

| Ingredient | Percentage (%) |
|---|---|
| Water | 45.5500 |
| Organic BSC Liquid - 25x | 13.00 |
| Alkyl Polyglucoside 50% con | 30.00 |
| Sodium Gluconate | 1.50 |
| Potassium Hydroxide (KOH) | 1.50 |

Phase 2: In a separate mixing vessel, 35 gallons of glycerin, 10 gallons of phenethyl alcohol, 35 gallons of saponified coco soap and 8.6 pounds of aloe are added and the mixture agitated on medium/medium-high with propeller mixer agitation. Next, 30 pounds of xanthan gum is added slowly to 15 gallons of glycerin to avoid clumping. The agitation is continued until the xanthan gum appears to be thoroughly pre-dispersed in the mixture.

The mixtures of phase 1 and phase 2 are mixed together by gradually adding the mixture of phase 1 to the phase 2 tank under medium mixing with propeller mixer agitation. Phase 1 should be added slow enough to allow the glycerin/xanthan/alcohol mixture to effectively hydrate. In addition, the pH should be checked and adjusted as necessary with potassium hydroxide to balance the pH level between 9 and 10.

Table 2 shows the listing of ingredients, and specific percentages used, to formulate the phase 2 mixture.

TABLE 2

(Phase 2 mixture)

| Ingredient | Percentage (%) |
|---|---|
| Glycerin | 5.00 |
| Phenethyl Alcohol | 1.00 |
| Saponified Coco Soap 30% | 3.50 |
| Xanthan Gum | 0.35 |
| Organic *Aloe* - 100x | 0.1000 |

The final composition is light yellow in color and appears transparent. It has a sweet odor, a specific gravity between 1.12 and 1.13 and a pH between 9 and 10.

While exemplary embodiments incorporating the principles of the present application has been disclosed herein, the present application is not limited to the disclosed embodiments. Instead, this application is intended to cover any variations, uses, or adaptations of the application using its general principles. Further, this application is intended to cover such departures from the present disclosure as come within known or customary practice in the art to which this present application pertains and which fall within the limits of the appended claims.

The terminology used herein is for the purpose of describing particular illustrative embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed herein could be termed a second element, component, region, layer or section without departing from the teachings of the example embodiments.

What is claimed is:

1. A natural laundry detergent, comprising:
an alkyl polyglucoside emulsifier in an amount of from about 28% to about 32% by weight of the composition;
a natural surfactant in an amount of from about 3.0% to about 23% by weight of the composition;
water in an amount of less than about 60% by weight of the composition;
a saponified oil in an amount of from about 0.50% to about 10.5% by weight of the composition;
an organic chelating agent in an amount of from about 0.10% to about 2.5% by weight of the composition;
one or more preservative in an amount of from about 0.10% to about 2.0% by weight of the composition; and
a polymeric thickening component in an amount of from about 0.05% to about 1.0% by weight of the composition.

2. The natural laundry detergent of claim 1, wherein the natural surfactant includes one or more fruit extracts.

3. The natural laundry detergent of claim 2, wherein the one or more fruit extracts are obtained from at least one of *Sapindus delavay, Sapindus detergens, Sapindus emarginatus, Sapindus laurifolius, Sapindus marginatus, Sapindus mukorossi, Sapindus oahuensis, Sapindus rarak, Sapindus saponaria, Sapindus tomentosus, Sapindus trifoliatus*, and *Sapindus vitiensis*.

4. The natural laundry detergent of claim 1, wherein the natural surfactant comprises a non-ionic botanical surfactant.

5. The natural laundry detergent of claim 4, wherein the non-ionic botanical surfactant comprises berry saponin concentrate.

6. The natural laundry detergent of claim 5, wherein the berry saponin concentrate is present in an amount of from about 8.0% to about 16% by weight of the composition.

7. The natural laundry detergent of claim 1, wherein the saponified oil is derived from a vegetable oil or animal fat selected from the group consisting of almond oil, apricot kernel oil, avocado oil, babassu oil, beef tallow, borage oil, canola oil, castor oil, cocoa butter, coconut oil, corn oil, cottonseed oil, emu oil, grapeseed oil, hazelnut oil, illipe butter, jojoba oil, kukui nut oil, lard, macadamia nut oil, mango butter, neem oil, olive oil, palm oil, palm kernel oil, peach kernel oil, peanut oil, rice bran oil, safflower oil, sesame oil, shea butter, soybean oil, stearic acid, sunflower oil, walnut oil, and wheat germ oil.

8. The natural laundry detergent of claim 7, wherein the saponified oil is present in an amount of from about 2.0% to about 5.0% by weight of the composition.

9. The natural laundry detergent of claim 1, further comprising potassium hydroxide.

10. The natural laundry detergent of claim 1, further comprising a carrier, the carrier including a blend of water and effective amounts of a fruit extract, one or more saponified oils and glycerin.

11. The natural laundry detergent of claim 10, wherein the carrier further comprises one or more processing aids to adjust the pH of the composition.

12. The natural laundry detergent of claim 10, wherein the carrier further comprises a natural viscosifier or a thickening agent.

13. The natural laundry detergent of claim 1, wherein the polymeric thickening component is selected from the group consisting of a natural polysaccharide or a cellulose material.

14. The natural laundry detergent of claim 13, wherein the natural polysaccharide or the cellulose material is selected from the group consisting of guar gum, locust bean gum and xanthan gum.

15. The natural laundry detergent of claim 14, wherein the polymeric thickening component is present in an amount of from about 0.20% to about 0.50% by weight of the composition.

16. The natural laundry detergent of claim 1, further comprising an organic aloe.

17. The natural laundry detergent of claim 1, wherein the detergent has a specific gravity between about 1.12 and about 1.13 and a pH between about 9 and about 10.

18. A natural laundry detergent, comprising:
an alkyl polyglucoside emulsifier that is present in the amount of from about 28% to about 32% by weight of the composition;
a non-ionic botanical surfactant including a berry saponin concentrate, the berry saponin concentrate being present in an amount of from about 8.0% to about 16% by weight of the composition;
water in an amount of from about 40% to about 50% by weight of the composition;
a saponified oil in an amount of from about 2.0% to about 5.0% by weight of the composition, the saponified oil being derived from a vegetable oil or animal fat selected from the group consisting of almond oil, apricot kernel oil, avocado oil, babassu oil, beef tallow, borage oil, canola oil, castor oil, cocoa butter, coconut oil, corn oil, cottonseed oil, emu oil, grapeseed oil, hazelnut oil, illipe butter, jojoba oil, kukui nut oil, lard, macadamia nut oil, mango butter, neem oil, olive oil, palm oil, palm kernel oil, peach kernel oil, peanut oil, rice bran oil, safflower oil, sesame oil, shea butter, soybean oil, stearic acid, sunflower oil, walnut oil, and wheat germ oil;
an organic chelating agent including a gluconate selected from sodium gluconate, potassium gluconate, lithium gluconate, zinc gluconate, ferrous gluconate, and mixtures thereof, the gluconate being present in an amount of from about 1.0% to about 1.8% by weight of the composition;
a polymeric thickening component in an amount of from about 0.20% to about 0.50% by weight of the composition, the polymeric thickening component being selected from the group consisting of a natural polysaccharide or a cellulose material; and
an organic aloe;
wherein the detergent has a specific gravity between about 1.12 and about 1.13 and a pH between about 9 and about 10.

19. The natural laundry detergent of claim 18, further comprising one or more preservative present in the amount of from about 0.50% to about 1.50% by weight of the composition, the one or more preservative being selected from the group consisting of quaternary ammonium chlorides, quaternary ammonium carbonates, benzalkonium chloride, iodine containing compounds, hydantoins, isothiazolinones, parabens, dehydroacetic acid and salts thereof, isocil, chloroxylenol, chlorhexidine, phenoxyethanol, benzyl alcohol, phenethyl alcohol, benzoic acid and salts thereof, chlorobutanol, sorbic acid and salts thereof, triclosan, triclocarban, and mixtures thereof.

20. The natural laundry detergent of claim 18, further comprising potassium hydroxide.

21. The natural laundry detergent of claim 18, further comprising a carrier, the carrier including a blend of water and effective amounts of a fruit extract, one or more saponified oils and glycerin.

22. The natural laundry detergent of claim 18, wherein the natural polysaccharide or the cellulose material is selected from the group consisting of guar gum, locust bean gum and xanthan gum.

23. A natural laundry detergent composition, comprising:

an alkyl polyglucoside emulsifier in an amount of from about 20% to about 40% by weight of the composition;

a natural surfactant in an amount of from about 3.0% to about 23% by weight of the composition;

water in an amount of less than about 60% by weight of the composition;

a saponified oil in an amount of from about 0.50% to about 10.5% by weight of the composition;

an organic chelating agent in an amount of from about 0.10% to about 2.5% by weight of the composition, the organic chelating agent including a gluconate selected from sodium gluconate, potassium gluconate, lithium gluconate, zinc gluconate, ferrous gluconate, and mixtures thereof;

one or more preservative in an amount of from about 0.10% to about 2.0% by weight of the composition; and a polymeric thickening component in an amount of from about 0.05% to about 1.0% by weight of the composition.

24. A natural laundry detergent composition, comprising:

an alkyl polyglucoside emulsifier in an amount of from about 20% to about 40% by weight of the composition;

a natural surfactant in an amount of from about 3.0% to about 23% by weight of the composition;

water in an amount of less than about 60% by weight of the composition;

a saponified oil in an amount of from about 0.50% to about 10.5% by weight of the composition;

an organic chelating agent in an amount of from about 0.10% to about 2.5% by weight of the composition, the organic chelating agent including a gluconate selected from sodium gluconate, potassium gluconate, lithium gluconate, zinc gluconate, ferrous gluconate, and mixtures thereof;

one or more preservative in an amount of from about 0.10% to about 2.0% by weight of the composition, the one or more preservative being selected from the group consisting of quaternary ammonium chlorides, quaternary ammonium carbonates, benzalkonium chloride, iodine containing compounds, hydantoins, isothiazolinones, parabens, dehydroacetic acid and salts thereof, isocil, chloroxylenol, chlorhexidine, phenoxyethanol, benzyl alcohol, phenethyl alcohol, benzoic acid and salts thereof, chlorobutanol, sorbic acid and salts thereof, triclosan, triclocarban, and mixtures thereof; and a polymeric thickening component in an amount of from about 0.05% to about 1.0% by weight of the composition.

25. The natural laundry detergent composition of claim 24, wherein the one or more preservative is present in the amount of from about 0.50% to about 1.50% by weight of the composition.

26. The natural laundry detergent composition of claim 24, wherein the gluconate is present in an amount of from about 1.0% to about 1.8% by weight of the composition.

* * * * *